United States Patent [19]

Nakaji

[11] Patent Number: 4,635,401

[45] Date of Patent: Jan. 13, 1987

[54] DUPLEX-HEAD SURFACE GRINDER

[75] Inventor: Takayuki Nakaji, Kawanishi, Japan

[73] Assignee: Daisho Seiki Kabushiki Kaisha, Osaka, Japan

[21] Appl. No.: 782,152

[22] Filed: Oct. 1, 1985

Related U.S. Application Data

[62] Division of Ser. No. 528,475, Sep. 1, 1983, abandoned.

[51] Int. Cl.[4] ..... B24B 7/16

[52] U.S. Cl. ..... 51/5 D; 51/112; 51/290

[58] Field of Search ..... 51/5 D, 111 R, 118, 51/117, 116, 209 R, 112, 40, 25, 80 A, 80 R, 89, 290, 326, 3, 134, 112–114, 327; 125/11 R, 11 DF

[56] References Cited

U.S. PATENT DOCUMENTS

| | | | |
|---|---|---|---|
| 449,950 | 4/1891 | Rodgers et al. | 51/80 R |
| 766,403 | 8/1904 | Vincke | 51/111 R |
| 1,601,227 | 9/1926 | Stevens | 51/117 |
| 1,651,382 | 12/1927 | Gardner et al. | 51/134 |
| 2,556,067 | 6/1951 | Coffer, Jr. | 125/11 R |
| 2,673,425 | 3/1954 | Karnell | 51/209 R |
| 3,299,579 | 1/1967 | Jacobson | 51/117 |
| 3,859,756 | 1/1975 | Zerbola | 51/118 |

FOREIGN PATENT DOCUMENTS

| | | | |
|---|---|---|---|
| 0889390 | 12/1981 | U.S.S.R. | 51/5 D |

*Primary Examiner*—Frederick R. Schmidt
*Assistant Examiner*—Robert A. Rose
*Attorney, Agent, or Firm*—Armstrong, Nikaido, Marmelstein & Kubovcik

[57] ABSTRACT

A duplex-head surface grinder concentrically mounting annular low large-diameter grinding discs and high small-diameter grinding discs provided on inner peripheral sides thereof respectively to a pair of opposed disc-shaped grinding wheels for an opposed-double-spindle type duplex-head surface grinder, and disposing a driving shaft for a rotary carrier on one side of a space between both grinding wheels and a driving shaft for a two-stage dresser arm providing on both side faces grinding chips having different projecting lengths on the other side thereof parallel to a grinding wheel shaft respectively.

1 Claim, 6 Drawing Figures

DUPLEX-HEAD SURFACE GRINDER

This application is a division of application Ser. No. 528,475, filed Sept. 1, 1983, now abandoned.

This invention relates to an opposed-double-spindle type duplex-head surface grinder.

In a conventional duplex-head surface grinder, annular grinding discs having the same heights are fixed to a pair of opposed disc-shaped grinding wheels respectively, so that widths between ground surfaces of a big end and a small end of connecting rod are the same when an engine connecting rod is set as a work piece in a rotary carrier which enters between both grinding discs. However, in a conventional connecting rod the small end of the connecting rod has a large width between ground surfaces and the big end has a small width therebetween. Therefore, it becomes necessary to change the design of the connecting rod in order to perform grinding steps of the small end and the big end simultaneously by using the conventional duplex-head surface grinder. When the grinding steps for the big end and the small end are performed in separate processes, finishing accuracies are less accurate and working processes increase.

An object of this invention is that a work having a small width between ground surfaces and a large width therebetween can be ground simultaneously and with high precision. Another object of this invention is to make it possible to perform a simultanous and high-precision correction work for grinding discs having particular shape. Further another object of this invention is to make it easy for a work to be loaded in and unloaded from a rotary carrier and, at the same time, to make correction work for a dressing chip width of a dresser easy.

In order to accomplish the above objects, the following composition is incorporated in this invention. Namely, an annular low large-diameter grinding disc and a high small-diameter grinding disc, provided on an inner peripheral side thereof, are mounted concentrically to a pair of opposed disc-shaped grinding wheels to form an opposed-double-spindle type duplex-head surface grinder, respectively. A driving shaft for the rotary carrier is disposed on one side of a space between both grinding wheels. A driving shaft for a two-stage dresser arm, providing on both side faces grinding chips having different projecting lengths, is disposed on the other side of such space. Both closing shafts are parallel with the grinding wheel spindle.

BRIEF DESCRIPTION OF THE DRAWINGS

In FIG. 1, a pair of disc-shaped grinding wheels 1, 1 comprises base discs 2, 2, annular large-diameter grinding discs 3, 3 concentrically fixed to said base discs 2, 2 and small-diameter grinding discs 4, 4 respectively. Grinding wheels 1, 1 are opposed with a space 5 interposed therebetween. A grinding wheel spindle 6 of each grinding wheel 1 is freely rotatably supported by a grinding head 7 driven by motor 8. Each grinding head 7 is supported on a carriage 9 in such a manner as sliding freely in the direction of the arrow A, so that the distance of space 5 is freely adjustable.

Figure 3:
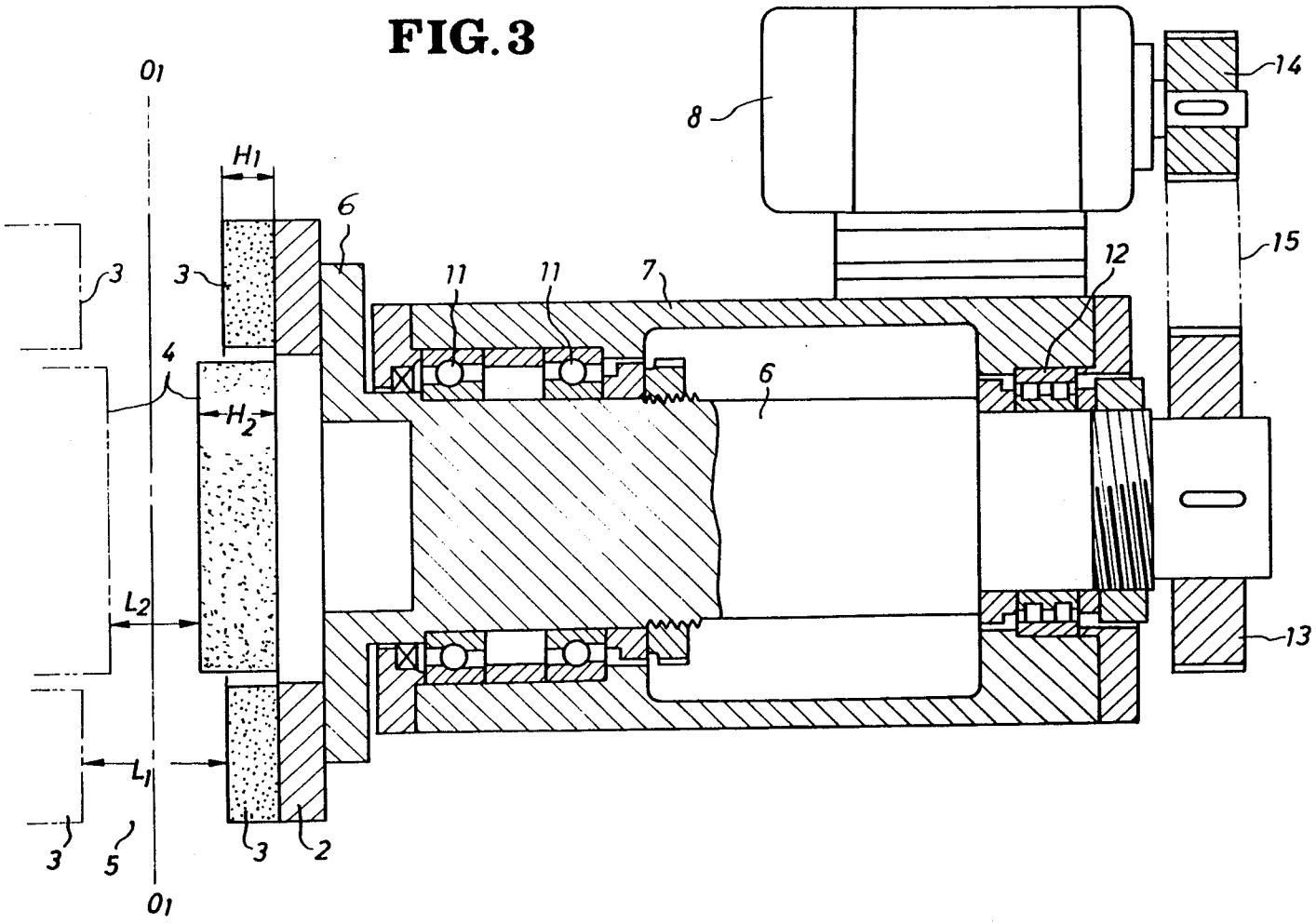
FIG. 3 is an enlarged partially sectional view taken on line III—III of FIG 2.

The grinding wheel spindle 6 for each head 7 is supported by the grinding head 7 through bearings 11, 12 and provided with a gear 13 at its tip end portion projecting from the grinding head 7. A chain or timing belt 15 is between gear 14 of motor 8 and gear 13, as best shown in FIG. 3. The projecting height $H_1$ of the grinding disc 3 is smaller than a projecting height $H_2$ of the grinding disc 4, so that a distance $L_1$ between a pair of opposed grinding discs 3, 3 is larger than a distance $L_2$ between opposed grinding discs 4, 4. A plane $O_1$—$O_1$ is a vertical reference plane at the center of the space 5 between the grinding discs, and distances from this reference plane $O_1$—$O_1$ to the opposed grinding discs 3, 3 and those from this plane to the grinding discs 4, 4 are equal respectively.

Figure 1:
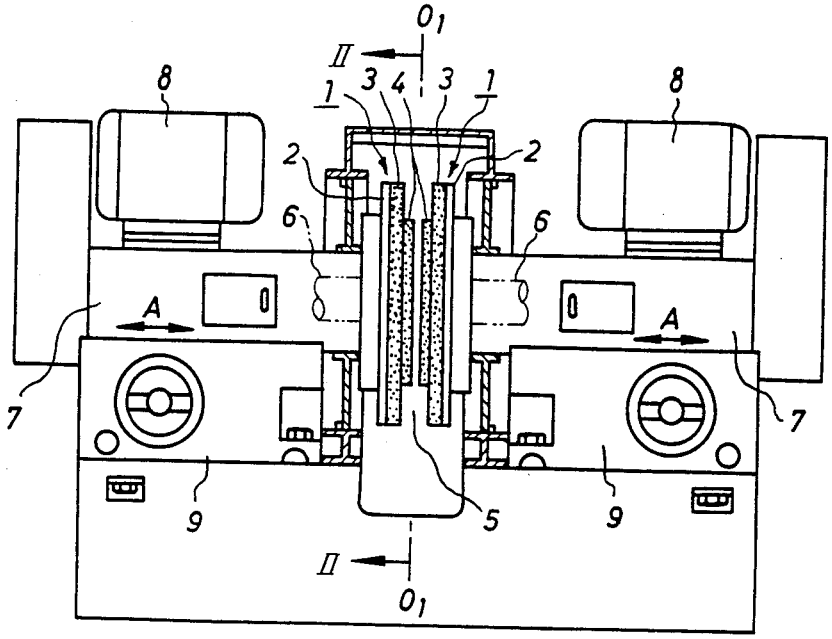
FIG. 1 is a front view, partially fragmentally, showing a duplex-head surface grinder according to this invention.
Figure 2:
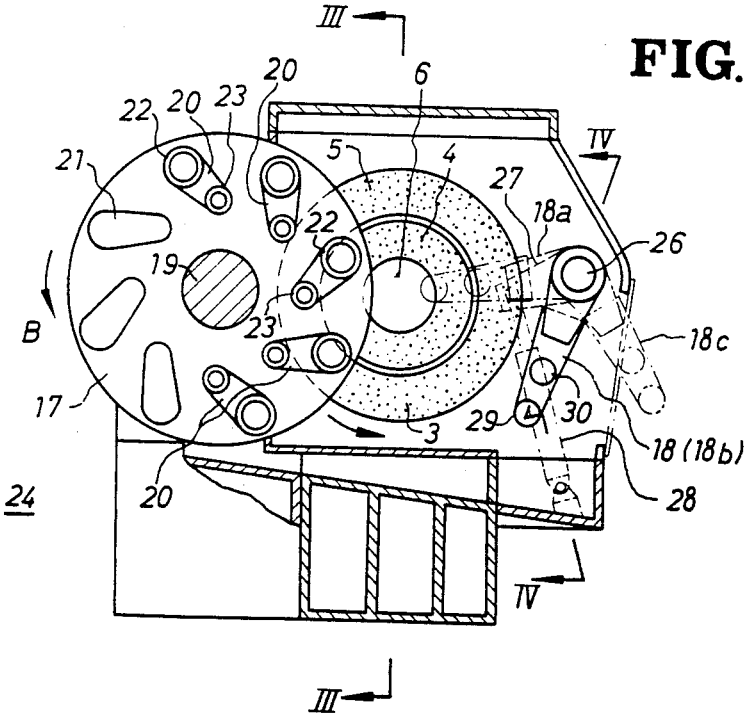
FIG. 2 is a sectional view taken on line II—II of FIG 1.

A rotary carrier 17 and a two-stage dresser arm 18 as best shown in FIG. 2, are disposed between the grinding discs on reference plane $O_1$—$O_1$.

In FIG. 2, a driving shaft 19 of the rotary carrier 17 is arranged in parallel with the grinding wheel spindle 6 and connected to a driving power source such as a motor (not shown) to be slowly rotated in the direction of the arrow B. The rotary carrier 17 is so designed that a part of it enters the space 5 between the grinding wheels, having a plurality of work loading portions 21 for loading a connecting rod 20. The connecting rod 20 is clamped in a hole of a work loading portion 21, and a pair of big end ground surfaces 22, 22 and a pair of small end ground surfaces 23, 23 are situated at positions symmetrically projecting to both sides of the rotary carrier 17 at an outer peripheral side and an inner peripheral side of the rotary carrier respectively. Consequently, when the unground connecting rod 20 to be ground is loaded successively in the work loading portion 21 at a work loading/unloading station 24 near to the rotary carrier 17, the big end ground surfaces 22, 22 will be ground between the narrowly spaced small-diameter grinding discs 4, 4 and the small end ground surfaces 23, 23 will be ground between the widely spaced large-diameter grinding discs 3, 3 as the rotary carrier 17 rotates in the direction of the arrow B. After completion of the grinding work, the ground connecting rod will be taken out at the work loading/unloading station 24.

A fixed driving shaft 26 for the two-stage dresser arm 18 is so supported as to be parallel with the grinding wheel spindle 6, and a small arm 27 on the driving shaft 26 is connected to a hydraulic cylinder 28. The two-stage dresser arm 18 can take up its position at a foreward position 18*a*, a backward position 18*b*, and a checking position 18*c* by means of the hydraulic cylinder 28. The dresser arm 18 has pairs of grinding chips 29, 30 at its tip end and a position deviated to the root side (the side of driving shaft 26) respectively. Therefore, a pair of dressing chips 29, 29 dresses and corrects a pair of the small-diameter grinding discs 4, 4 and a pair of dressing chips 30, 30 dresses and corrects a pair of the large-diameter grinding discs 3, 3 to prescribed dimensions respectively, during one reciprocating movement of the dresser arm 18 between the backward position 18*b* and the foreward position 18*a* by means of the hydraulic cylinder 28. The chips 29, 30 are periodically checked with a prescribed jig at the checking position 18*c* respectively.

Figure 4:
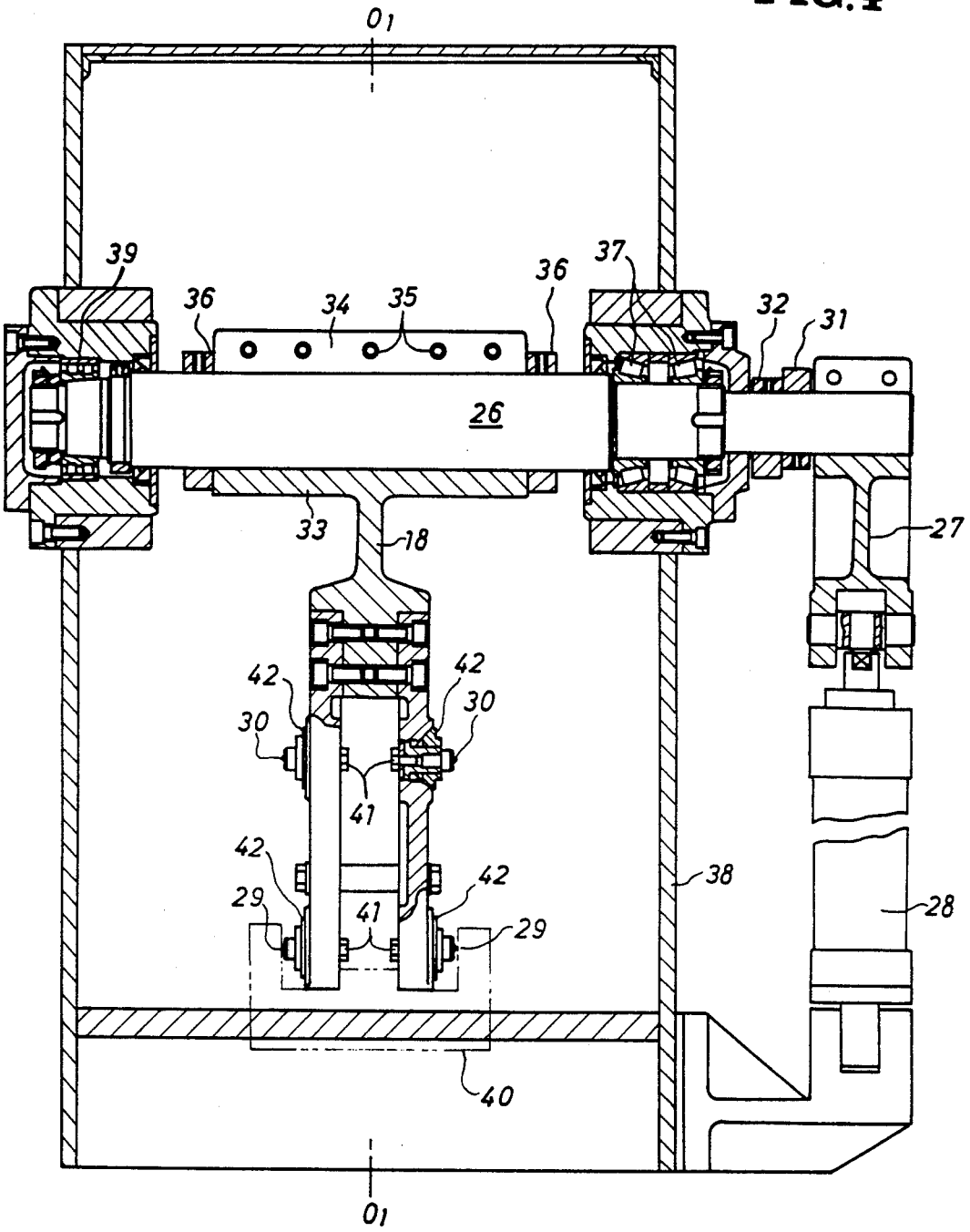
FIG. 4 is a schematic sectional view taken on line IV—IV of FIG. 2.
Figure 5:
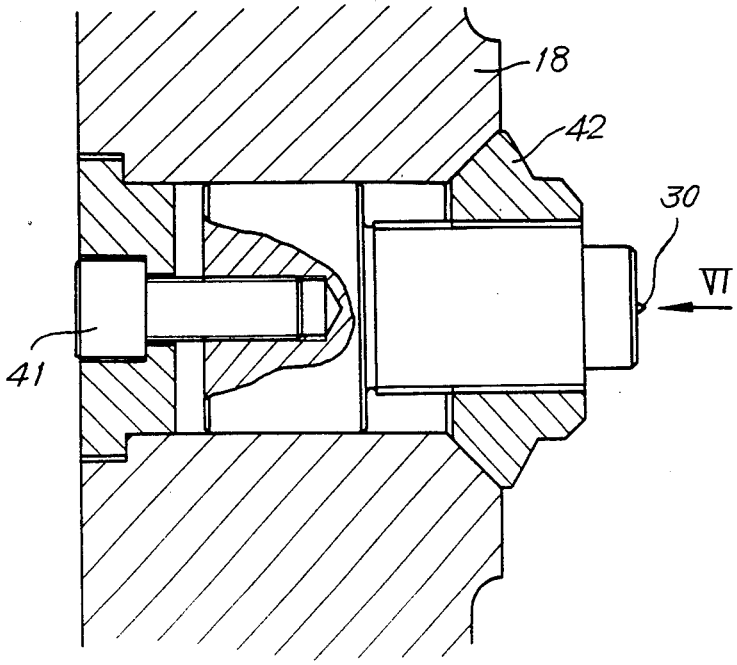
FIG. 5 is an enlarged view corresponding to a part of FIG. 4 for showing another embodiment.
Figure 6:
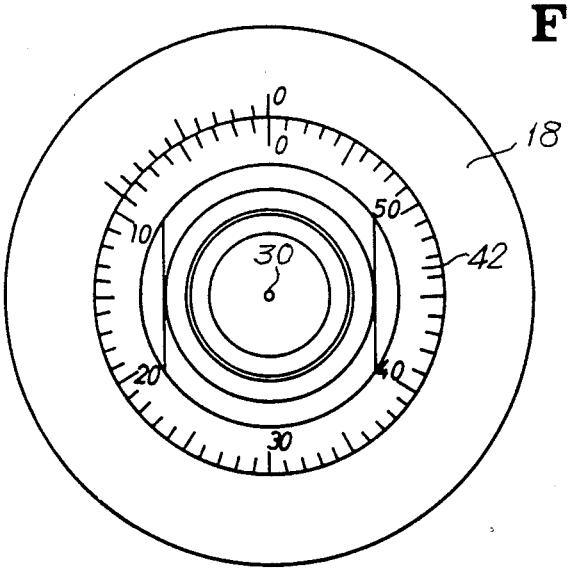
FIG. 6 is a drawing viewing in the direction of the arrow VI of FIG. 5.

In FIGS. 4; 32, 31 are cams fixed to the driving shaft 26, which operate together with limit switches (not shown) to limit a working range of the dresser arm 18. A boss cylinder 33 at the root of the dresser arm 18 has a pair of tightening flanges 34, 34 so that the dresser arm 18 can be changed its mounting angle on the driving shaft 26 by tightening a pair of the tightening flanges 34, 34 with plural bolts 35. 36 is a positioning ring for the arm 18. The driving shaft 26 is supported to one side wall of a grinding disc cover 38 through a thrust bearing 37, thus being defined its axial position. 39 is a double row cylindrical bearing.

Positions and projecting lengths of the grinding chips 29, 30 attached to both sides of the dresser arm 18 can be adjusted by the following procedure. Gauge 40 (FIG. 4) is fixed with the dresser arm 18 stopped at the checking position 18*c* (FIG. 2), bolts 41 are tightened, and graduated taper sockets 42 are rotated.

As described above, according to the present invention; the annular low large-diameter grinding discs 3, 3 and the high small-diameter grinding discs 4, 4 provided on the inner peripheral side thereof are mounted concentrically to a pair of disc-shaped grinding wheels 1, 1 respectively, and the driving shaft 19 for rotary carrier 17 is disposed on one side of the space 5 between the both grinding wheels 1, 1 and at the same time the driving shaft 26 for the two-stage dresser arm 18 providing on both sides grinding chips 29, 30 having different projecting lengths is disposed on the other side thereof parallel with the grinding wheel spindle 6 respectively; so that the work having two-stage ground surfaces on either side can be ground simultaneously and with high precision. Further, the dresser arm 18 does not obstruct the work in its loading/unloading in the rotary carrier 17, thus the loading/unloading work is made easier. Moreover, since the dresser arm 18 is disposed at an accessible position opposite to the rotary carrier, the dimensional check and correction of the grinding chips 29, 30 become easy. At the same time the simultaneous dimensional corrections for all the grinding discs 3, 4 become possible. Thus the working efficiency is improved.

What is claimed is:

1. An opposed, double-spindle type duplex-head surface grinder comprising:

(a) a pair of carriages mounted upon a base;

(b) a pair of grinding heads, each supported upon one of said carriages;

(c) a pair of grinding wheel spindles, each mounted in one of said grinding heads and connected to a power source so as to rotate said spindles about a longitudinal axis, said axes of said spindles lying along a common line;

(d) a pair of disc-shaped grinding wheels, each mounted to an end of one of said grinding wheel spindles so as to oppose each other, said wheel comprising a base disc, an annular large diameter grinding disc having a radially extending flat face perpendicular to said axis of said spindle and mounted to said base disc and a relatively smaller diameter grinding disc having the same composition as said large diameter grinding disc and mounted to said base disc at the center of said base disc, said radially extending flat face of said smaller diameter disc being positioned farther from said base disc than said radially extending flat face of said larger diameter disc.

(e) a rotary workpiece carrier mounted on a shaft parallel to said grinding wheel spindles so as to project a portion of said rotary work piece carrier between said grinding wheels, said rotary work piece carrier having a plurality of workpiece holders and adapted to interpose said work pieces between said grinding wheels as said shaft is rotated; and (f) a two-stage dresser arm having a base portion and a tip portion, each of which portions carries a pair of grinding chips mounted to project in opposite directions from said dresser arm and adjustable on said dresser arm so as to accurately control the distance between the opposed chips, the base portion of said dresser are being fixed to a shaft parallel to said grinding wheel spindles so as to interpose said dresser arm between the grinding wheel in a progressive manner and to simultaneously dress four faces of said grinding wheels; wherein a workpiece held in said workpiece holder is inserted between said grinding wheels in a postion such that flat surfaces on opposite sides of two portions of said work piece are simultaneously ground, the two portions having different thicknesses as measured perpendicular to the plane of said work piece carrier.

* * * * *